US007341250B2

(12) United States Patent
Lewis, Jr.

(10) Patent No.: US 7,341,250 B2
(45) Date of Patent: Mar. 11, 2008

(54) DICE GAME

(76) Inventor: James Lewis, Jr., 6713 Richlands Way, Sacramento, CA (US) 95823-7518

( * ) Notice: Subject to any disclaimer, the term of this patent is extended or adjusted under 35 U.S.C. 154(b) by 58 days.

(21) Appl. No.: 11/359,039

(22) Filed: Feb. 21, 2006

(65) Prior Publication Data

US 2007/0194527 A1 Aug. 23, 2007

(51) Int. Cl.
*A63F 9/04* (2006.01)

(52) U.S. Cl. ..... 273/146

(58) Field of Classification Search ..... None
See application file for complete search history.

(56) References Cited

U.S. PATENT DOCUMENTS 4,016,939 A * 4/1977 Thron ..... 273/244
4,378,115 A * 3/1983 Terrero ..... 463/43
4,856,780 A * 8/1989 Begley et al. ..... 273/244
4,984,805 A * 1/1991 Medlock ..... 273/248
5,054,775 A * 10/1991 Banks et al. ..... 273/431
5,217,229 A * 6/1993 Jaime ..... 273/247
5,901,956 A * 5/1999 Warmack ..... 273/244
6,530,571 B1 * 3/2003 McWilliams ..... 273/244.2
2004/0160002 A1 * 8/2004 England ..... 273/247
2006/0027963 A1 * 2/2006 Christensen et al. ..... 273/245
2006/0151949 A1 * 7/2006 Doskocil et al. ..... 273/277

* cited by examiner

*Primary Examiner*—Eugene Kim
*Assistant Examiner*—Dolores R. Collins
(74) *Attorney, Agent, or Firm*—Raymond M. Galasso; Galasso & Associates, LP

(57) ABSTRACT

The present invention relates a board game that utilizes a game board that has constructed thereon a field grid accommodating two players. The field grid is further defined to removably receive designations for position, roll amount and score for each player. The rounds of play are facilitated by utilizing a random number generator with the game consisting of sixteen rounds. The game further includes a position coin that is used to commence the game and determine that starting position for the players.

12 Claims, 2 Drawing Sheets

DICE GAME

FIELD OF THE INVENTION

The present invention relates a board game to be played by more than one individual, more specifically but not by way of limitation, to an apparatus and associated rules for playing a board game wherein the object of the game is to accumulate more points than your opponent, whereby the points are generated with a random number generator.

BACKGROUND

Playing board games has been a popular pastime amongst individuals for decades. There have been many games heretofore devised and utilized constructed of familiar and expected configurations in order to achieve numerous objectives and requirements.

The advantages of the present board game will be understood more readily after a consideration of the drawings and Detailed Description.

SUMMARY OF THE INVENTION

It is an object of the present invention to provide a new board game and a method of playing thereof that is designed to contain a plurality of rounds of play with each player alternating between offensive and defensive positions with an objective to accumulate the most points.

It is a further object of the present invention to provide a new board game that utilizes random number generators to facilitate the playing of each round of play during the game.

It is another object of the present invention to provide a new board game that accommodates two players and utilizes a game board that contains a grid that facilitates the recording of the players' position, the amount generated by the random number generator and the score.

It is a further object of the present invention to provide a new board game that can be used to conduct a tournament style of play between a total of thirty six players.

It is another object of the present invention to provide a new board game that is easy to use.

To the accomplishment of the above and related objects the present invention may be embodied in the form illustrated in the accompanying drawings. Attention is called to the fact that the drawings are illustrative only. Variations are contemplated as being part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
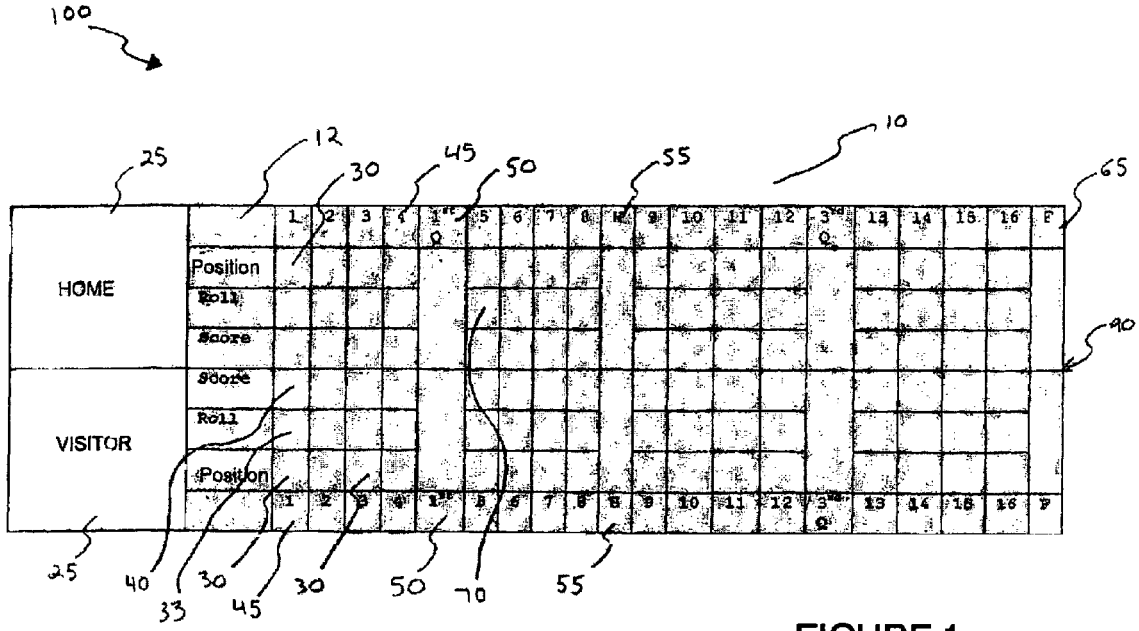
FIG. 1 illustrates a perspective schematic diagram of one embodiment of the playing surface suitable for use with the game of the present invention.
Figure 2:
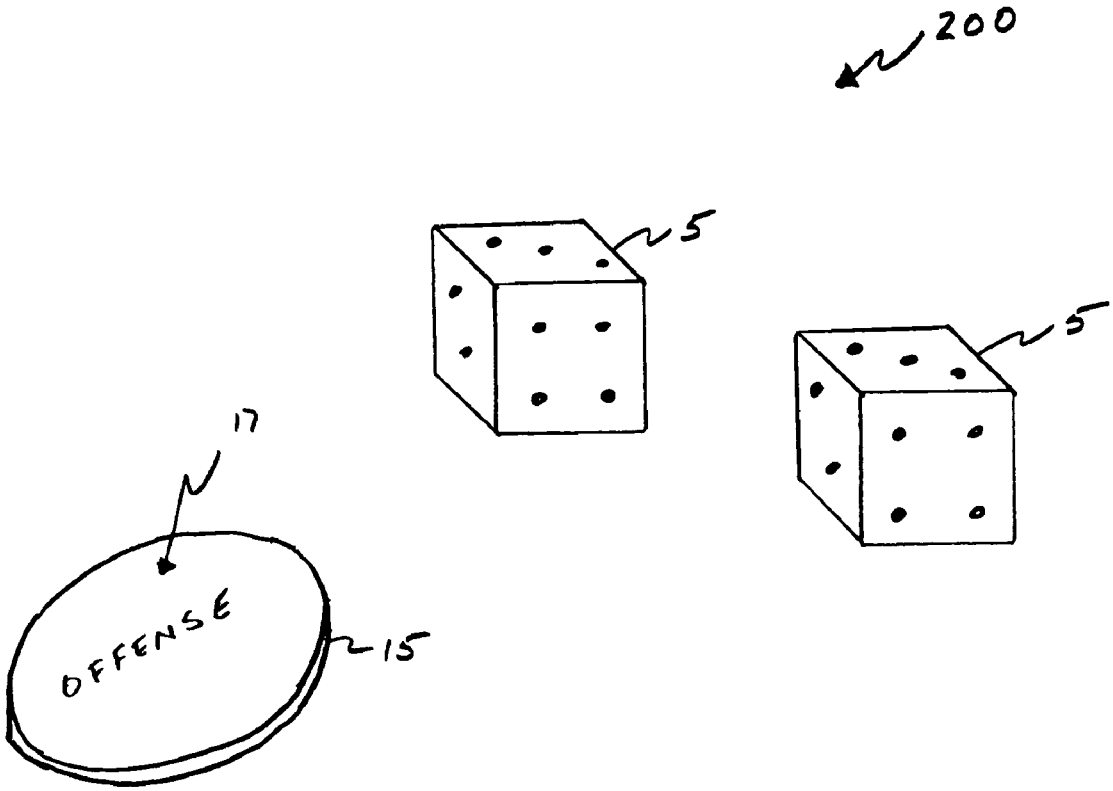
FIG. 2 illustrates a perspective view of the tokens suitable for use with the game of the present invention.

Referring now to the drawings, wherein the various elements depicted are not necessarily drawn to scale, and in particular FIGS. 1 and 2, there is illustrated a board game 100 comprising of the elements according to the principles of the present invention.

The elements of one embodiment of the board game 100 include a game board 10, a pair of random number generators 5 and a position coin 15. Typically the game will be played by two players. The rules of the game require that a player use the position coin 15 to determine the position of each player at the commencement of the board game 100. The position coin 15 is a standard two-sided coin that has a single position designation 17 on each side. One side of the position coin 15 designates offense while the opposite side thereof designates defense. Those skilled in the art will recognize that while the position designation 17 illustrated in the drawings submitted herewith are in written words, it is within the scope of the present invention that the position designation 17 could be designated by numerous alternatives in place of and/or in conjunction with words. More specifically but not by way of limitation, the position designation 17 could be a symbol.

The game board 10 has a plurality of spaces 12 thereon. The spaces 12 are generally square in shape and are configured in a linear manner in a plurality of superposed rows, each row functioning to record specific information during play. The spaces 12 are configured to removably receive the designations therein. It is further contemplated within the scope of the present invention that that game board 10 could consist of a sheet of paper that has printed thereon the grid 90 necessary to conduct the board game 100.

The game board 10 has two team designation spaces 25 that function to identify the two teams, one for each player. The team designation spaces 25 in the present embodiment are designated with the identifiers home and visitor. Those skilled in the art will recognize that numerous team names could be used in place of and/or in conjunction with home and visitor. More specifically but not by way of limitation the team designation space 25 could be printed with different team names upon manufacturing of the game board 10. Furthermore, while the game board 10 is illustrated as a schematic diagram in the drawings submitted herewith, it is contemplated within the scope of the present invention that the game board 10 could be the field component of a miniature stadium to enhance the simulation of playing a field game such as but not limited to football. It is also contemplated within the scope of the present invention that the board game 100 could additionally be comprised of team player tokens. The team player tokens would have human-like head and thigh representations with a body that resembled a field grid. The team player tokens would have thereon names such as but not limited to Ace, Deuce, Trey, Quattro, Fevor and Big6.

The game board 10 further includes adjacent to the team designation spaces 25 a plurality of position designation spaces 30 configured in a linear row. The position designation spaces 30 function to identify the position of each player as originally determined by the tossing of the position coin 15. The position coin 15 is used to commence the board game 100 to determine whether the player will have the position of offense or defense. The player that is designated as the home team will toss the position coin 15 to commence the game. The player that is designated as the visitor team must begin the board game 100 subsequent to tossing the position coin 15 and thereby accepting the position designation 17 indicated thereon the upwardly facing side of the position coin 15. Subsequent to the first round of play, each player will alternate positions during each round of the game. For example, if the visitor player commences with an offense designation in the first round, the home player will be offense for the second round. This will continue through the first eight rounds. A round consists of each player using a random number generator 5 such as but not limited to a six sided die. Although no particular type of die is required, it is contemplated within the scope of the present invention that the die for each player be identifiable. More specifically but not by way of limitation the dice could be different colors such as red and green. The opposing players roll the die once during each round. A score is determined as reference herein for each round. The players alternate positions through the first eight rounds. In the ninth round the player with the home team designation will begin by using the position that was used in the first round by the opposing player. During the rounds the position designation 17 of each team is tracked and recorded in the position designation space 30. The position designation space 30 functions to provide a space for the players to removably record whether their respective position is offense or defense as determined by the position coin 15 at the commencement of the board game. The position coin 15 is only used in the first round as previously referenced herein. The player's position of offense or defense subsequent to the initial round will alternate thereafter.

The game board 10 further consists of a linear row of round designation spaces 45. The round designation spaces 45 are generally square in shape and have designated therein the round numbers. Although no specific amount of round numbers are required, good results have been achieved using round designation spaces 45 designated with the number one through the number sixteen. Interposed amongst the round designation spaces 45 are the quarter designation spaces 50. The players will play the board game 100 according to the rules referenced herein for four rounds. Subsequent to each round, the players will utilize the rules referenced herein to determine the score achieved for each player. The players will record the number produced by the random number generator 5 for each round in the respective roll amount space 33. Subsequently each player will record their respective score in the scoring tabulation space 40. At the end of four rounds of play the players will tabulate their cumulative score from the preceding four rounds as designated in the scoring tabulation space 40 and record in the quarter designation space 50. Each player will perform this task at the end of every fourth round. Subsequent to eight rounds of play, the players will tabulate their respective scores and record in the half designation space 55. Ensuing to playing rounds nine through sixteen the players will tabulate their cumulative score for all sixteen rounds. The player accumulating the most points wins.

The spaces 12 on the game board 10 are configured to removably receive the appropriate scoring or position designations for each player. More specifically but not by way of limitation, the players could use erasable pen or pencil to record their scores, position and number rolled for each round. It is contemplated within the scope of the present invention that the board game 100 could additionally contained magnetic pieces with the required information thereon such as but not limited to position designation, score and numbers used to record the number generated by the player with the roll of their die to be releasably secured into the appropriate space 12.

The board game 100 in its intended form is designed to accommodate 2 players simultaneously to compete against one another for sixteen rounds of play. It is contemplated within the scope of the present invention that the board game 100 could be used to construct a tournament with the tournament having therein a plurality of conferences, divisions and teams. More specifically but not by way of limitation the board game 100 could be used to facilitate a tournament between thirty six players. The players would be divided up between into two conferences of eighteen players. Each conference would have three divisions containing six players.

An example league of two conferences, three divisions and thirty six players is listed below. Those skilled in the art will recognize that numerous combinations of conferences, teams and divisions are possible within the framework of an elimination tournament. Furthermore, those skilled in the art will recognize that numerous team names could be used and the team names referenced herein is for illustrative purposes only. One example of a possible configuration for a tournament contest and a sample contest schedule for one week, or level of the tournament amongst the thirty six teams is:

| Rank | Alpha Division | Rank | Beta Division | Rank | Delta Division |
|---|---|---|---|---|---|
| | | | Glory Conference | | |
| 1 | Admirals | 1 | Gimmicks | 1 | Frustrators |
| 2 | Illusions | 2 | Moderators | 2 | Breakers |
| 3 | Rangers | 3 | Imitators | 3 | Cyclones |
| 4 | Tornadoes | 4 | Tenacles | 4 | Modifiers |
| 5 | Hurricanes | 5 | Predators | 5 | Sonics |
| 6 | Echoes | 6 | Oxidators | 6 | Radials |
| | | | Honor Conference | | |
| 1 | Sentinels | 1 | Kinetics | 1 | Levers |
| 2 | Volcanoes | 2 | Saucers | 2 | Flickers |
| 3 | Mediators | 3 | Dictators | 3 | Hornets |
| 4 | Calculators | 4 | Flames | 4 | Centrals |
| 5 | Resistors | 5 | Clouds | 5 | Spectrums |
| 6 | Foilers | 6 | Formulators | 6 | Bumbees |

Week_01 01 vs 04 02 vs 05 03 vs 06

| Game Number | Home | vs | Visitor |
|---|---|---|---|
| 1 | Admirals | | Tornadoes |
| 2 | Illusions | | Hurricanes |
| 3 | Rangers | | Echoes |
| 4 | Sentinels | | Calculators |
| 5 | Volcanoes | | Resistors |
| 6 | Mediators | | Foilers |
| 7 | Gimmicks | | Tenacles |
| 8 | Moderators | | Predators |
| 9 | Imitators | | Oxidators |
| 10 | Kinetics | | Flames |
| 11 | Saucers | | Clouds |
| 12 | Dictators | | Formulators |
| 13 | Frustrators | | Modifiers |
| 14 | Breakers | | Sonics |
| 15 | Cyclones | | Radials |
| 16 | Levers | | Centrals |
| 17 | Flickers | | Spectrums |
| 18 | Hornets | | Bumbees |

Those skilled in the art will recognize that numerous configurations are possible for determining which team plays each other at a particular point in an elimination style tournament. One example of configurations possible for organizing the contests amongst the teams based on initial ranking within the respect conferences is:

Example Tournament Schedule

| | Schedule | | | Initial Rank |
|---|---|---|---|---|
| Week 01 | 01 vs 04 | 02 vs 05 | 03 vs 06 | 010402050306 |
| Week 02 | 01 vs 05 | 02 vs 06 | 03 vs 04 | 010502060304 |
| Week 03 | 01 vs 06 | 02 vs 03 | 04 vs 05 | 010602030405 |
| Week 04 | ga vs gb | ha vs hb | gd vs hd | gagbhahbgdhd |
| Week 05 | 01 vs 02 | 03 vs 05 | 04 vs 06 | 010203050406 |
| Week 06 | 05 vs 06 | 01 vs 03 | 02 vs 04 | 050601030204 |
| Week 07 | ga vs hb | gb vs hd | gd vs ha | gahbgbagdgha |
| Week 08 | 01 vs 04 | 02 vs 05 | 03 vs 06 | 010402050306 |
| Week 09 | 01 vs 05 | 02 vs 06 | 03 vs 04 | 010502060304 |
| Week 10 | 01 vs 06 | 02 vs 03 | 04 vs 05 | 010602030405 |
| Week 11 | ga vs gd | ha vs hd | gb vs hb | gagdhahdgbhb |
| Week 12 | 01 vs 02 | 03 vs 05 | 04 vs 06 | 010203050406 |
| Week 13 | 05 vs 06 | 01 vs 03 | 02 vs 04 | 050601030204 |
| Week 14 | ga vs ha | gd vs gb | ga vs hb | gahagdgbhdhb |
| Week 15 | 01 vs 04 | 02 vs 05 | 03 vs 06 | 010402050306 |
| Week 16 | 01 vs 05 | 02 vs 06 | 03 vs 04 | 010502060304 |
| Week 17 | ga vs hd | ha vs gd | gb vs hb | gahdhagdgbhb |
| Week 18 | 01 vs 06 | 02 vs 03 | 04 vs 05 | 010602030405 |
| Week 19 | 01 vs 02 | 03 vs 05 | 04 vs 06 | 010203050406 |
| Week 20 | 05 vs 06 | 01 vs 03 | 02 vs 04 | 050601030204 |

Example of play between divisions (Week 14): Glory Conference Alpha Division plays against Honor Conference Alpha Division. The teams initially ranked 01 plays against each other, teams initially ranked 02 play each other, continuing until all equally ranking teams are matched in a game.

It is contemplated within the scope of the present invention that a tournament with the board game 100 amongst a plurality of teams could involve a potential monetary reward. An example pricing schedule is listed below that demonstrates one possible permutation for tournament play. Those skilled in the art will recognize that numerous different permutations of a pricing schedule could be used in place of and/or in conjunction with the pricing schedule referenced herein.

| Example Pricing Schedule | Game Payment | Games | Total Game Cost | Players | Cost |
|---|---|---|---|---|---|
| Regular Season Games | $1.00 | 20 | $20.00 | 36 | $720.00 |
| Playoff Games | $1.00 | 11 | $11.00 | 36 | $396.00 |
| Total | $2.00 | 31 | $31.00 | | $1,116.00 |
| Regular Season Winners | $1.20 | 20 | $24.00 | 18 | $432.00 |
| Regular Season Losers | $0.00 | 20 | $0.00 | 18 | $0.00 |
| Regular Season Organizers | $0.60 | 20 | $12.00 | 18 | $216.00 |
| Administrative Fee | $0.20 | 20 | $4.00 | 18 | $72.00 |
| Total | $2.00 | | $40.00 | | $720.00 |
| Playoff 1st Round Winners | $0.60 | 4 | $10.80 | | $43.20 |
| Playoff 1st Round Losers | $0.40 | 4 | $7.20 | | $28.80 |
| Playoff 1st Round Bye Teams | $0.80 | 2 | $14.40 | | $28.80 |
| Playoff Organizers | $0.00 | 4 | $0.00 | | $0.00 |
| Administrative Fee | $0.20 | 4 | $3.60 | | $14.40 |
| Total | $2.00 | | $36.00 | | $115.20 |
| Playoff 2nd Round Winners | $1.26 | 4 | $24.00 | | $95.99 |
| Playoff 2nd Round Losers | $0.56 | 4 | $8.00 | | $32.09 |
| Playoff Organizers | $0.00 | 4 | $0.00 | | $0.00 |
| Administrative Fee | $0.22 | 4 | $4.00 | | $16.05 |
| Total | $2.04 | | $36.03 | | $144.12 |
| Championship Winners | $1.32 | 2 | $27.34 | | $54.67 |
| Championship Losers | $0.46 | 2 | $13.67 | | $27.34 |
| Championship Organizers | $0.00 | 2 | $0.00 | | $0.00 |
| Administrative Fee | $0.25 | 2 | $4.56 | | $9.11 |

-continued

| Example Pricing Schedule | Game Payment | Games | Total Game Cost | Players | Cost |
|---|---|---|---|---|---|
| Total | $2.02 | | $45.56 | | $91.12 |
| Board Game Winner | $1.32 | 1 | $31.89 | | $31.89 |
| Board Game Loser | $0.46 | 1 | $9.11 | | $9.11 |
| Board Game Organizers | $0.00 | 1 | $0.00 | | $0.00 |
| Administrative Fee | $0.25 | 1 | $4.56 | | $4.56 |
| Total | $2.02 | | $45.56 | | $45.56 |
| Playoffs Payout | | | | | Total |
| Playoff 1st Round | | | | | $115.20 |
| Playoff 2nd Round | | | | | $144.12 |
| Championship | | | | | $91.12 |
| Random Bowl | | | | | $45.56 |
| Total Check | | | | | $396.00 |

The pricing schedule referenced herein demonstrates potential pricing for an elimination style tournament with each team owner, or player investing an equal amount according to the pre-determined pricing schedule.

An example of a set of rules for a game constructed in accordance with an embodiment of the present invention as follows:

Contents:

A game board 10. A pair of dice 5 and a position coin 15.

One strategy and instruction sheet will be included with the board game 100.

Directions and Rules of the Game:

Object of the Game: The object of the game is to accumulate more points through the sixteen rounds of play than your opponent.

Start the Game:

The game is commenced by the player who has chosen to be the team with the designation, home, using the position coin 15 to determine the position of the team with the designation, visitor. The player playing as the home team will toss the position coin 15. Subsequent to the landing of the position coin 15 the upwardly facing side will have displayed thereon the position designation 17 of the visitor. The position coin 15 has thereon two position designations 17. One side of the position coin 15 is designated as offense and the opposing side of the position coin 15 is designated as defense. The player playing as the visitor team must commence the game utilizing the position designation 17 determined by the tossing of the position coin 15.

The position designation 17 alternates for each round thereafter with the exception of the start of the ninth round. In round nine, the player playing as the home team begins with the position designation 17 of the opposing player from round one. Subsequent to round nine, the position designation 17 will continue to alternate for each round until the completion of the board game 100 at round 16.

Rounds:

The board game 100 comprises of sixteen rounds. Four rounds comprise a quarter of play. Rounds one through four represent the first quarter, rounds five through eight represent the second quarter, rounds nine through 12 represent the third quarter and rounds thirteen through sixteen represent the fourth quarter. During each round, each player will roll their die one time. The roll of the die determines the score achieved in each round.

Quarters:

The board game has four quarters. The first and second quarters comprise the first half and the third and fourth quarters comprise the second half. Each players score is tabulated at the end of each quarter in addition to the tabulation subsequent to each round.

Scoring:

Each player's score is determined by their position designation 17 and the number generated by the roll of their respective die. The following table summarizes the scoring for the board game. A scoring example has been indicated in bold type in the scoring tables herein, in the first table if the player with a position of offense rolls a six with their die and the player designated as defense rolls a one on their die, the player designated as offense will record 5 points for round one in the scoring designation space 45 and the player designated as defense will record zero points for round one. All possible scoring configurations from a six sided die are referenced below in the scoring table.

Scoring Tables:

| | | | | | | |
|---|---|---|---|---|---|---|
| Offense Roll | 6 | 6 | 6 | 6 | 6 | 6 |
| Offense Points | 5 | 4 | 3 | 2 | 1 | 0 |
| Defense Points | 0 | 0 | 0 | 0 | 0 | 1 |
| Defense Roll | 1 | 2 | 3 | 4 | 5 | 6 |
| Offense Roll | 5 | 5 | 5 | 5 | 5 | 5 |
| Offense Points | 4 | 3 | 2 | 1 | 0 | 0 |
| Defense Points | 0 | 0 | 0 | 0 | 1 | 0 |
| Defense Roll | 1 | 2 | 3 | 4 | 5 | 6 |
| Offense Roll | 4 | 4 | 4 | 4 | 4 | 4 |
| Offense Points | 3 | 2 | 1 | 0 | 0 | 0 |
| Defense Points | 0 | 0 | 0 | 1 | 0 | 0 |
| Defense Roll | 1 | 2 | 3 | 4 | 5 | 6 |
| Offense Roll | 3 | 3 | 3 | 3 | 3 | 3 |
| Offense Points | 2 | 1 | 0 | 0 | 0 | 0 |
| Defense Points | 0 | 0 | 1 | 0 | 0 | 0 |
| Defense Roll | 1 | 2 | 3 | 4 | 5 | 6 |
| Offense Roll | 2 | 2 | 2 | 2 | 2 | 2 |
| Offense Points | 1 | 0 | 0 | 0 | 0 | 0 |
| Defense Points | 0 | 1 | 0 | 0 | 0 | 0 |
| Defense Roll | 1 | 2 | 3 | 4 | 5 | 6 |
| Offense Roll | 1 | 1 | 1 | 1 | 1 | 1 |
| Offense Points | 0 | 0 | 0 | 0 | 0 | 0 |
| Defense Points | 1 | 0 | 0 | 0 | 1 | 1 |
| Defense Roll | 1 | 2 | 3 | 4 | 5 | 6 |

While the described embodiment of present invention is a game board 10 and corresponding tokens 200, it is contemplated to be within the scope of the present invention that the game could also be fashioned either in part or whole electronically or rendered in part or whole in computer software and hardware. More specifically but not by way of limitation, a software program could be utilized to manage a tournament schedule as described herein controlling such aspects as but not limited too game scheduling, pricing, playoff schedule, team assignments and monetary payouts.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of playing a board game comprising:

using a playing surface, said playing surface having:

a plurality of spaces configured in rows further being oriented in a generally linear manner, said spaces being further configured for providing an area for removably receiving designations for each player selected from a group consisting of position designation, roll amount and score;

selecting a team designation fro the participating players, said team designation being selected from a group consisting of home or visitor;

tossing of a position coin by the player designated as home team to determine the position of the player designated as visitor; said position coin having two position designations thereon, said position designations being offense position on one side of the position coin and defense position on the opposing side of the position coin;

utilizing a random number generator; said random number generator configured to produce a number between and including one and six, said random number generator being utilized once for each of said players during a round of play;

completing a round of play, said round of play being completed once said players for each of said team has utilized the random number generators one time;

tabulating a score, said tabulation of said score being derived from a predetermined scoring sheet displaying all possible scoring options for numbers generated by each player using said random generator; wherein the team in the position of defense can accumulate points if the player for the defense generates an equal number to the number generated by the player for the offense;

alternating positions, said players alternating position designations upon completion of one round of play and subsequent moving to the next round of play;

accumulating points, said players accumulate points during each round of play for purposes of determining a winner based upon the highest point accumulation.

2. The method of claim 1, wherein the random number generator is a six sided die.

3. The method of claim 1, wherein the players engage in sixteen rounds of play to determine a winner.

4. The method of claim 3, wherein the score for the team in the position of offense is five points upon the generation of the number six by the offensive team and the generation of the number one by the defensive team in the same round of play.

5. The method of claim 3, wherein the score for the team in the position of offense is four points upon the generation of the number six by the offensive team and the generation of the number two by the defensive team in the same round of play.

6. The method of claim 3, wherein the score for the team in the position of offense is three points upon the generation of the number six by the offensive team and the generation of the number three by the defensive team in the same round of play.

7. The method of claim 3, wherein the score for the team in the position of offense is two points upon the generation of the number six by the offensive team and the generation of the number four by the defensive team in the same round of play.

8. The method of claim 3, wherein the score for the team in the position of offense is one point upon the generation of the number six by the offensive team and the generation of the number five by the defensive team in the same round of play.

9. A method of playing a board game comprising:

having two players, each of said players having one random number generator, each player in turn using said random number generator at least one time on a playing surface, said playing surface having:

a plurality of spaces configured in linear rows, said spaces being further configured for providing an area for removably receiving designations for selected from a group consisting of position, roll amount and score;

selecting a team designation for each of said players, said team designation being selected from a group consisting of home or visitor;

tossing a position coin, said position coin having two position designations thereon, said designations being offense position on one side of the position coin and defense position on the opposing side of the position coin;

utilizing a random number generator; said random number generator configured to produce a number between and including one and six, said random number generator being utilized once for each of said player during a round of play;

completing a round of play, said round of play being completed once said players has utilized the random number generators one time;

tabulating a score, said tabulation of said score being derived from a predetermined scoring sheet displaying all possible scoring options for numbers generated for each player, said score being further recorded in said spaces; wherein the player in the position of defense can accumulate points if the player for the defense generates an equal number with said random number generator to the number generated by the player for the offense;

alternating positions, said players alternating position designations upon completion of one round of play and subsequent moving to the next round of play;

accumulating points, said players accumulating points during each round of play.

10. The method of claim 9, wherein said player with the team designation of home commences the game by tossing the position coin to determine the position designation for the first round for the player playing with the team designation of visitor.

11. The method of claim 10, wherein playing a round is accomplished by said players rolling one six sided die one time per player.

12. The method of claim 11, wherein said players pay for a total of sixteen rounds to determine a winner based upon the highest point accumulation.

* * * * *